US008858299B2

(12) United States Patent
Boelter

(10) Patent No.: US 8,858,299 B2
(45) Date of Patent: Oct. 14, 2014

(54) DEVICE AND METHOD FOR PROCESSING A BLADE EDGE

(71) Applicant: Thomas Benjamin Boelter, Le Sueur, MN (US)

(72) Inventor: Thomas Benjamin Boelter, Le Sueur, MN (US)

( * ) Notice: Subject to any disclaimer, the term of this patent is extended or adjusted under 35 U.S.C. 154(b) by 152 days.

(21) Appl. No.: 13/645,746

(22) Filed: Oct. 5, 2012

(65) Prior Publication Data

US 2014/0099867 A1 Apr. 10, 2014

(51) Int. Cl.
*B24B 3/54* (2006.01)

(52) U.S. Cl.
CPC ..... *B24B 3/54* (2013.01)
USPC ..... 451/54; 451/349

(58) Field of Classification Search
CPC ..... B24B 3/54
USPC ..... 451/45, 349
See application file for complete search history.

(56) References Cited

U.S. PATENT DOCUMENTS

| | | | | | |
|---|---|---|---|---|---|
| 905,638 | A | * | 12/1908 | Von Beust | 451/541 |
| 3,058,268 | A | * | 10/1962 | Sjoquist | 451/267 |
| 3,546,819 | A | | 12/1970 | Campbell | |
| 4,265,055 | A | | 5/1981 | Cartwright et al. | |
| 4,646,477 | A | * | 3/1987 | Robertson | 451/540 |
| 4,807,401 | A | * | 2/1989 | Atwater | 451/45 |
| 5,018,310 | A | | 5/1991 | Fierus et al. | |
| 5,133,157 | A | * | 7/1992 | Hulskotte | 451/180 |
| 5,245,789 | A | | 9/1993 | Rees et al. | |
| 5,390,445 | A | | 2/1995 | Giovanazzi et al. | |
| 5,645,470 | A | | 7/1997 | Ludwig | |
| 6,071,181 | A | * | 6/2000 | Wightman et al. | 451/192 |
| 6,290,582 | B1 | * | 9/2001 | Eklund | 451/263 |
| 6,398,633 | B1 | * | 6/2002 | Lothe | 451/545 |

FOREIGN PATENT DOCUMENTS

| | | |
|---|---|---|
| GB | 309806 | 8/1928 |
| JP | 06-008117 | 1/1994 |

OTHER PUBLICATIONS

Tru Hone HR8 Honer—Tru Hone Corporation, http://www.truhone.com/store/pc/viewCategories.asp?idCategory=9 (printed Oct. 26, 2011).
Tru Hone Knife Sharpener—Tru Hone Corporation, http://www.truhone.com/store/pc/viewCategories.asp?idCategory=3 (printed Oct. 26, 2011).
Knife Sharpening Machines—TRUHONE equipped for edge polishing, Polish the cutting edge for superior performance, http://www.startfoodtech.coma . . . (printed Oct. 11, 2011).
Knife Sharpening Machines—Replacement Sharpening Heads, http://www.startfoodtech.coma . . . (printed Oct. 11, 2011).
Handling and Maintenance of Tools and Core Equipment, http://www.fao.org/cocrep/010/ . . . (printed Oct. 11, 2011).

* cited by examiner

*Primary Examiner* — Maurina Rachuba
(74) *Attorney, Agent, or Firm* — Merchant & Gould P.C.

(57) ABSTRACT

A blade processing (e.g., sharpening) device includes two sets of overlapping edge processing rings. Inner diameter surfaces of the edge processing rings define a notch suitable for effectively processing a blade with a convex cutting edge profile. Certain types of edge processing rings are movable relative to one another to adjust an edge processing angle of the notch. Certain types of blade processing devices also can also process blades with concave cutting edge profiles. The rings may be contained at least partially within a protective housing. A blade can be processed by inserting a blade through a blade insertion opening in the housing and into the notch while a handle of the blade remains outside the housing. By grasping the handle, the blade can be manually reciprocated within the notch during edge processing.

27 Claims, 13 Drawing Sheets

DEVICE AND METHOD FOR PROCESSING A BLADE EDGE

TECHNICAL FIELD

The present disclosure relates generally to blade processing devices and methods. More particularly, the present disclosure relates to blade processing devices and methods for providing a blade with a convex cutting edge profile.

BACKGROUND

Cutting blades (e.g., knife blades, razor blades, etc.) can be provided with a variety of different types of cutting edge profiles. Example cutting edge profiles include concave cutting edge profiles 20 (see FIG. 1), straight cutting edge profiles 22 (see FIG. 2) and convex cutting edge profiles 24 (see FIG. 3). The functionality and durability of a cutting blade is dependent upon the shape of the cutting edge profile. In general, it is desirable to use a blade having a strong cutting edge with long-lasting sharpness. In this regard, convex cutting edge profiles are known to provide a particularly strong edge with long-lasting sharpness. However, the type of cutting edge profile desired by a given individual is generally dependent on intended use and user preference.

Blade sharpening is a precise process that typically is highly dependent upon the skill of the person performing the sharpening. Traditionally, blade sharpening is performed by using abrasive sharpening elements such as abrasive belts, abrasive wheels, or abrasive stones. The sharpening elements can be stationary or driven (e.g., rotated, vibrated, oscillated, or otherwise moved by a drive mechanism). During sharpening of a blade, the person performing the sharpening manipulates (e.g., rocks, rolls, pivots, or otherwise moves) the blade relative to the sharpening element to provide the edge of the blade with a desired cutting edge profile. The quality of the blade edge after sharpening is directly related to the experience and skill of the person responsible for the sharpening.

Automated blade sharpening devices have been developed to facilitate effectively sharpening a blade without requiring an operator of high skill and experience. Example automated blade sharpening devices are disclosed at U.S. Pat. Nos. 5,018,310; 5,245,789; and 4,265,055 and at British Ref. No. GB 309,806. Improvements in this area are needed.

SUMMARY

One aspect of the present disclosure relates to a device for effectively and efficiently processing a blade with a convex cutting edge profile. In certain embodiments, the device is easy to use and provides consistent, reliable edge processing performance without requiring a substantial level of operator skill or training. In certain embodiments, the device can be effectively used on a variety of different types and styles of blades.

Another aspect of the present disclosure relates to a device that can process blades with convex cutting edge profiles and can also process blades with concave cutting edge profiles. In certain embodiments, the device can include at least two overlapping edge processing rings.

A further aspect of the present disclosure relates to a blade processing device that includes two sets of overlapping edge processing rings. Inner diameter surfaces of the edge processing rings define a notch suitable for effectively processing a blade with a convex cutting edge profile.

Still another aspect of the present invention relates a blade processing device that includes at least two overlapping edge processing rings. Inner diameter surfaces of the edge processing rings define a notch suitable for effectively processing a blade with a convex cutting edge profile. The edge processing rings are movable relative to one another to adjust an edge processing angle of the notch. In certain embodiments, the edge processing rings have widths that are substantially smaller than the inner diameters of the edge processing rings.

A further aspect of the present disclosure relates to a blade processing device that includes at least two overlapping edge processing rings contained at least partially within a protective housing. Inner diameter surfaces of the edge processing rings define a notch suitable for effectively processing a blade with a convex cutting edge profile. The housing defines a blade insertion opening that aligns with the notch. A blade is processed by inserting a blade through the blade insertion opening and into the notch while a handle of the blade remains outside the housing. By grasping the handle, the blade can be manually reciprocated within the notch during edge processing.

A variety of additional inventive aspects will be set forth in the description that follows. The inventive aspects can relate to individual features and to combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 3:
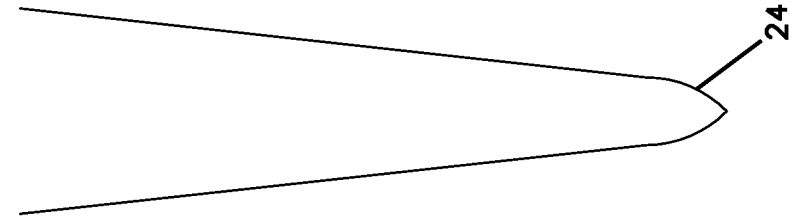
FIG. 3 shows a prior art blade having a convex cutting edge profile.
Figure 2:
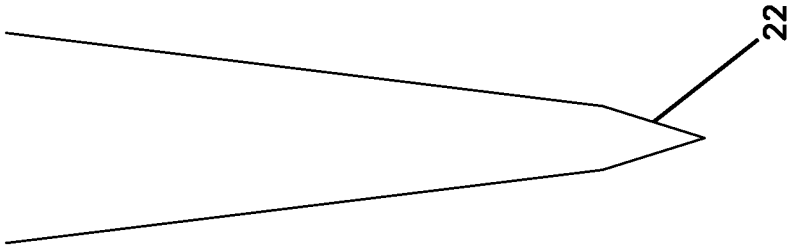
FIG. 2 shows a prior art blade having a straight cutting edge profile.
Figure 1:
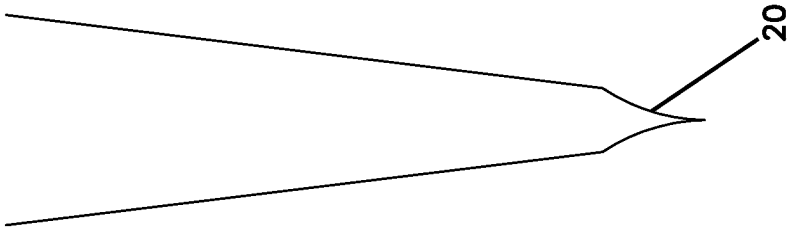
FIG. 1 shows a prior art blade having a concave cutting edge profile.
Figure 4:
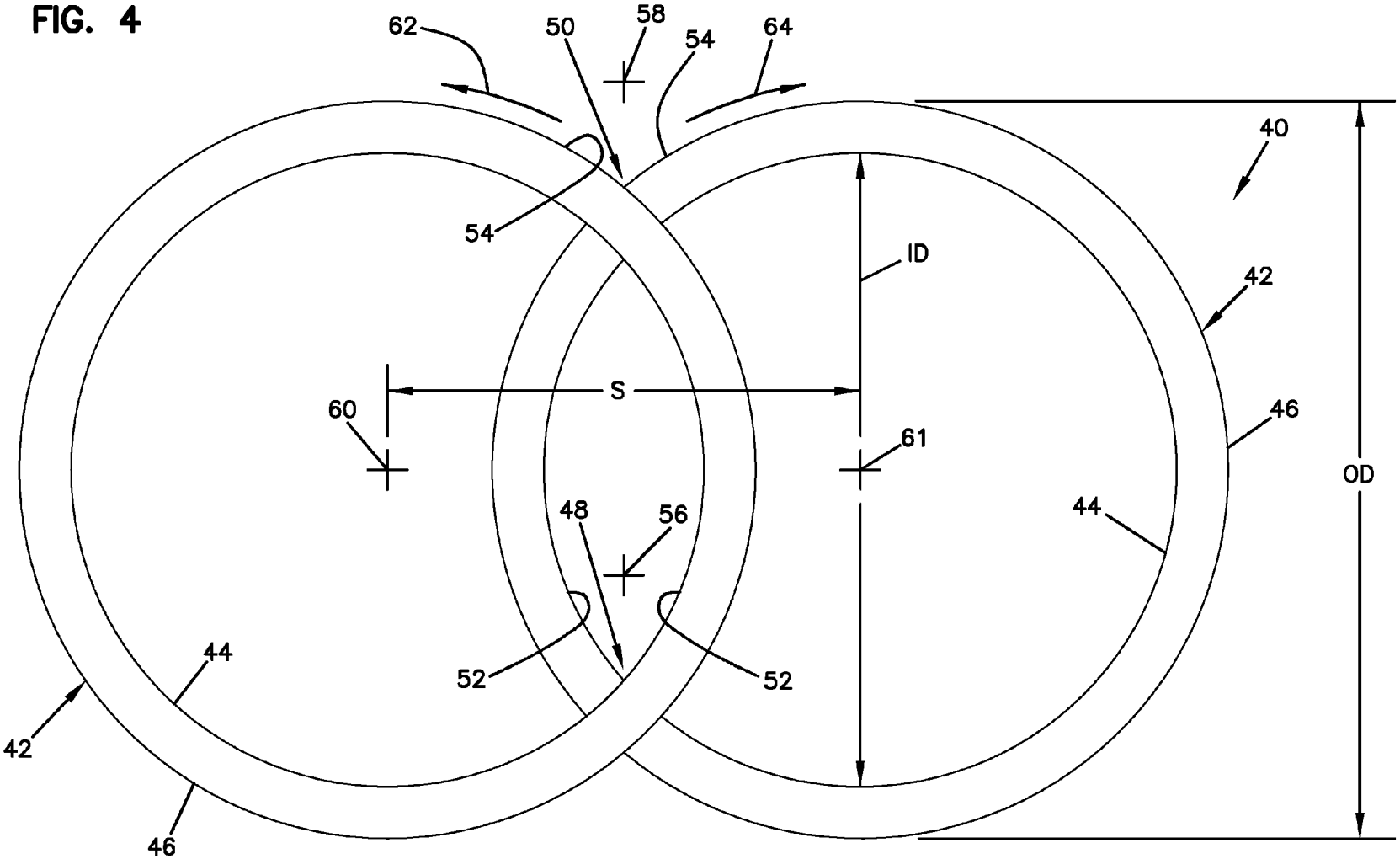
FIG. 4 is a front view of a blade processing device in accordance with the principles of the present disclosure.

FIG. 4 shows a blade edge processing device 40 in accordance with the principles of the present disclosure. The blade edge processing device 40 includes overlapping edge processing rings 42. The edge processing rings 42 include inner diameters ID and outer diameters OD. The inner diameters ID are defined by inner diameter surfaces 44 suitable for processing the edge of a blade and the outer diameters OD are defined by outer diameter surfaces 46 suitable for processing the edge of a blade. The inner diameter surfaces 44 have concave curvatures and the outer diameter surfaces 46 have convex curvatures. The overlapping edge processing rings 42 define a first blade processing location in the form of a first notch 48 (i.e., a first nip) and a second blade processing region in the form of a second notch 50 (i.e., a second nip). The first notch 48 is defined by the inner diameter surfaces 44 of the overlapping edge processing rings 42 and the second notch 50 is defined by the outer diameter surfaces 46 of the overlapping edge processing rings 42. The first notch 48 has opposite concave sides 52 defined by the inner diameter surfaces 44 and the second notch 50 has opposing convex sides 54 defined by the outer diameter surfaces 46. The first notch 48 is adapted for processing a blade with a convex cutting edge profile that matches or compliments the shape of the first notch 48. The second notch is adapted for processing a blade with a concave cutting edge profile that matches or compliments the second notch 50.

To process a blade with a convex cutting edge profile, the blade is inserted into the first notch 48 along a first blade insertion axis 56 such that the edge of the blade fits within the first notch 48. The blade can then be reciprocated back and forth along the first blade insertion axis 56 within the first notch 48 such that the entire length of the blade edge can be processed by the inner diameter surfaces 44 at the first notch 48.

To process a blade with a concave cutting edge profile, the blade is inserted into the second notch 50 along a second blade insertion axis 58 such that the edge of the blade fits within the second notch 50. The blade can then be reciprocated back and forth along the second blade insertion axis 58 within the second notch 50 such that the entire length of the blade edge can be processed by the outer diameter surfaces 46 at the second notch 50.

During processing of a blade edge, the edge processing rings 42 can be rotated about spaced-apart first and second axes of rotation 60, 61. Preferably, the overlapping edge processing rings 42 are rotated such that the edge processing surfaces of the edge processing rings 42 move upwardly across the blade edge during processing. As shown at FIG. 4, the overlapping edge processing rings 42 are rotated in opposite directions with the left edge processing ring 42 being rotated about the first axis of rotation 60 in a counterclockwise direction 62 and the right edge processing ring 42 being rotated about the second axis of rotation 61 in a clockwise direction 64. While it is preferred to rotate the edge processing rings 42 during blade edge processing, in alternative embodiments, the edge processing rings 42 can remain stationary during blade edge processing.

Referring still to FIG. 4, the first and second axes 60, 61 are spaced apart from one another by a spacing S that is less than the inner diameters ID of the edge processing rings 42. Because of the size of the spacing S, the edge processing rings 42 overlap one another to form the first and second notches 48, 50. In certain embodiments, the edge processing rings 42 can be moved relative to one another to adjust the size of the spacing S. By adjusting the size of the spacing S, the processing angles defined by the first and second notches 48, 50 can be adjusted.

As used herein, the term "edge processing" includes edge sharpening, edge honing, edge straightening, edge steeling, edge grinding, edge polishing, and edge whetting. The inner and outer diameter surfaces 44, 46 preferably have a construction suitable for processing a metal blade edge. In certain embodiments, the inner and outer diameter surfaces 44, 46 can include materials such as steel, carborundum (silicon carbide), diamond grit, aluminum oxide, boron nitride, or other materials. The edge processing rings 42 preferably have a relatively rigid, non-resilient construction. In certain embodiments, the edge processing rings 42 can be manufactured of a base material such as steel. In certain embodiments, the base material of the edge processing rings 42 can be suitable for processing blades. In other embodiments, edge processing material can be applied (e.g., coated, impregnated, or otherwise attached) to the inner and outer diameters of the base material forming the edge processing rings such that the edge processing material defines the inner and outer diameter surfaces 44, 46 of the edge processing rings 42.

One advantage of using an edge processing device having overlapping edge processing rings is the ability to provide both first and second edge processing notches for allowing the device to process both concave cutting edge profiles and convex cutting edge profiles. However, aspects of the present disclosure are not limited to having two notches. Instead, certain embodiments may only utilize the aspects relating to the first notch 48 for processing convex cutting edge profiles.

Figure 5:
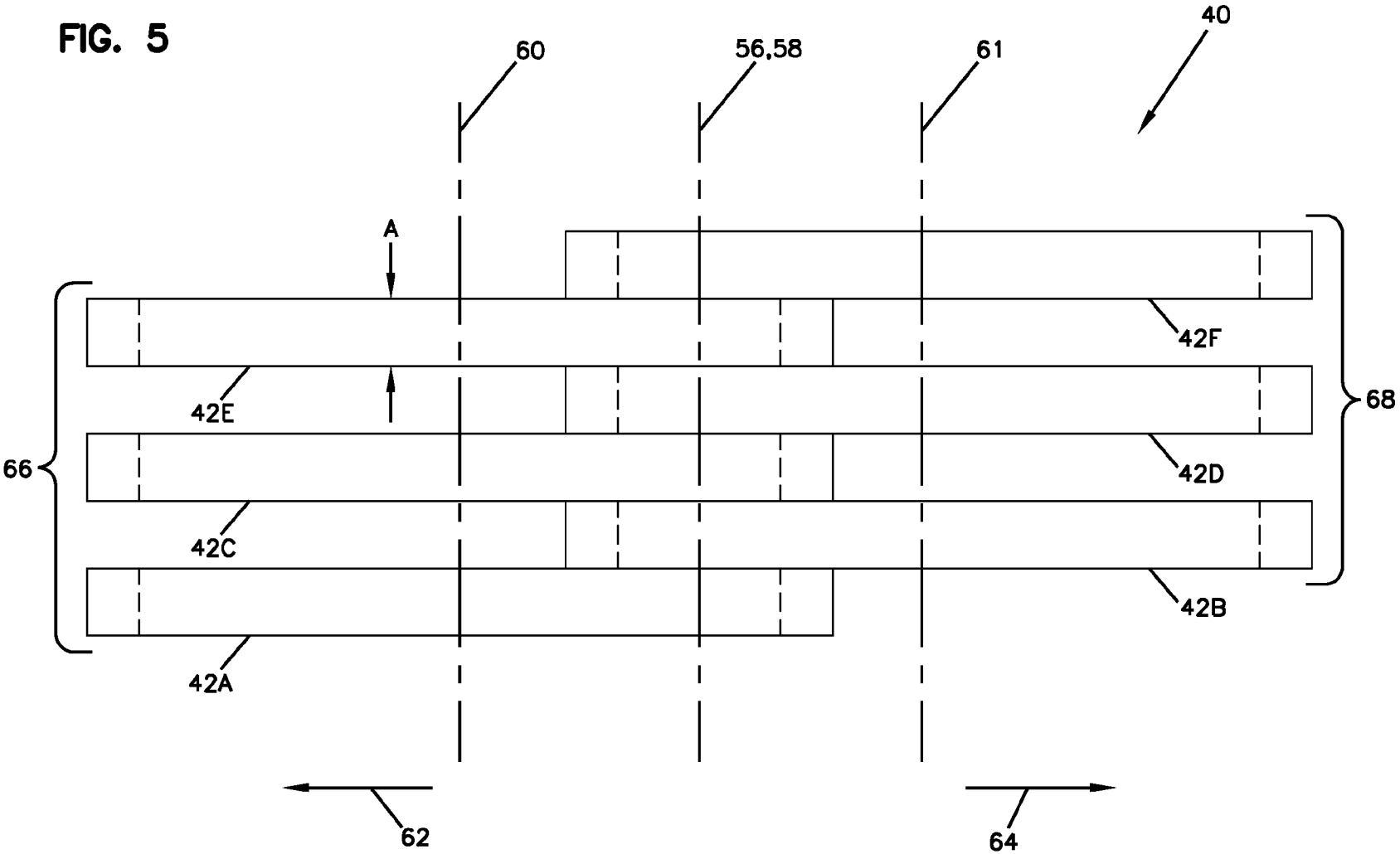
FIG. 5 is a top view of the blade processing device of FIG. 4.

Referring to FIG. 5, the blade processing device 40 includes a first edge processing ring 42A, a second edge processing ring 42B, a third edge processing ring 42C, a fourth edge processing ring 42D, a fifth edge processing ring 42E and a sixth edge processing ring 42F. The first, third and fifth edge processing rings 42A, 42C, and 42E form a first ring set 66 aligned along the first axis of rotation 60. The second, fourth and sixth edge processing rings 42B, 42D, and 42F form a second ring set 68 aligned along the second axis of rotation 61. The edge processing rings 42 of the first and second ring sets 66, 68 are interleaved with respect to one another.

Each of the ring sets 66, 68 preferably includes at least two edge processing rings 42. In the depicted embodiment, each of the first and second ring sets 66, 68 includes three edge processing rings 42. In other embodiments, each of the first and second ring sets 66, 68 may include more than three edge processing rings 42. In other embodiments, blade edge processing devices in accordance with the principles of the present disclosure may include only two overlapping edge processing rings 42.

During blade processing, the first ring set 66 is preferably rotated about the first axis of rotation 60 (e.g., in the counterclockwise direction 62) and the second ring set 68 is rotated about the second axis of rotation 61 (e.g., in the clockwise direction 64). It will be appreciated that drive arrangements including motors, belts, gears or other mechanisms can be used to rotate the edge processing rings 42 about their respective axes 60, 61 during edge processing. In the depicted embodiment, the first and second axes of rotation 60, 61 are parallel to one another and all of the edge processing rings 42 are shown having equal inner diameters ID and equal outer diameters OD.

The first and second ring sets 66, 68 cooperate to define the first and second notches 48, 50 (FIG. 4) of the blade edge processing device 40. As shown at FIG. 5, the edge processing rings 42 have axial dimensions A that correspond to widths of the edge processing rings 42. The axial dimensions A are measured in an orientation parallel to the axes of rotation 60, 61. It is preferred for the axial dimensions A to be relatively short as compared to the inner diameters ID of the edge processing rings 42. The short nature of the axial dimensions A assist in ensuring that essentially the entire edge of a blade is processed as the blade is axially reciprocated relative to the ring set 66, 68 along one of the blade insertion axes 56, 58 during blade processing. In certain embodiments, the axial dimensions A are less than or equal to one inch, or less than or equal to 0.75 inches, or less than or equal or to 0.5 inches, or less than or equal to 0.25 inches. In certain embodiments, the inner diameters ID of the edge processing rings 42 are in the range of 3 to 14 inches, or in the range of 4-9 inches, or in the range of 5 to 8 inches. It will be appreciated that the use of larger diameter rings allows blades having larger blade heights to be processed. Thus, the diameters of the rings can correspond to the size of the blades intended to be processed. In certain embodiments, each inner diameter ID is at least two times as large as each corresponding axial dimension A. In other embodiments, each inner diameter is at least four times as large as each corresponding axial dimension A. In still further embodiments, each inner diameter ID is at least 6, 10 or 20 times as large as each corresponding axial dimension A. Of course, embodiments having other sizes and size ratios are also within the scope of the present disclosure.

Figure 6:
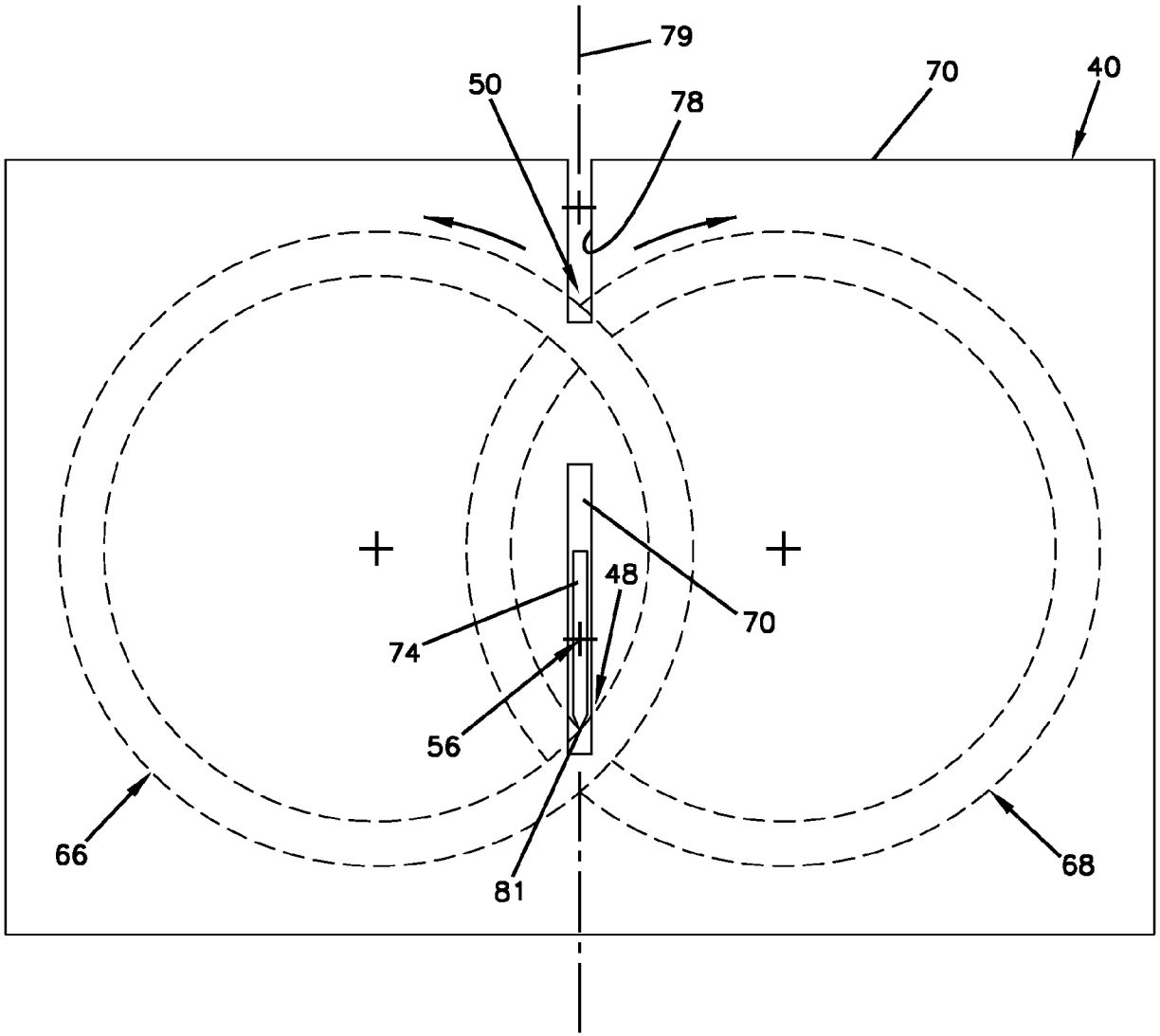
FIG. 6 shows the blade processing device of FIG. 4 within a housing.
Figure 7:
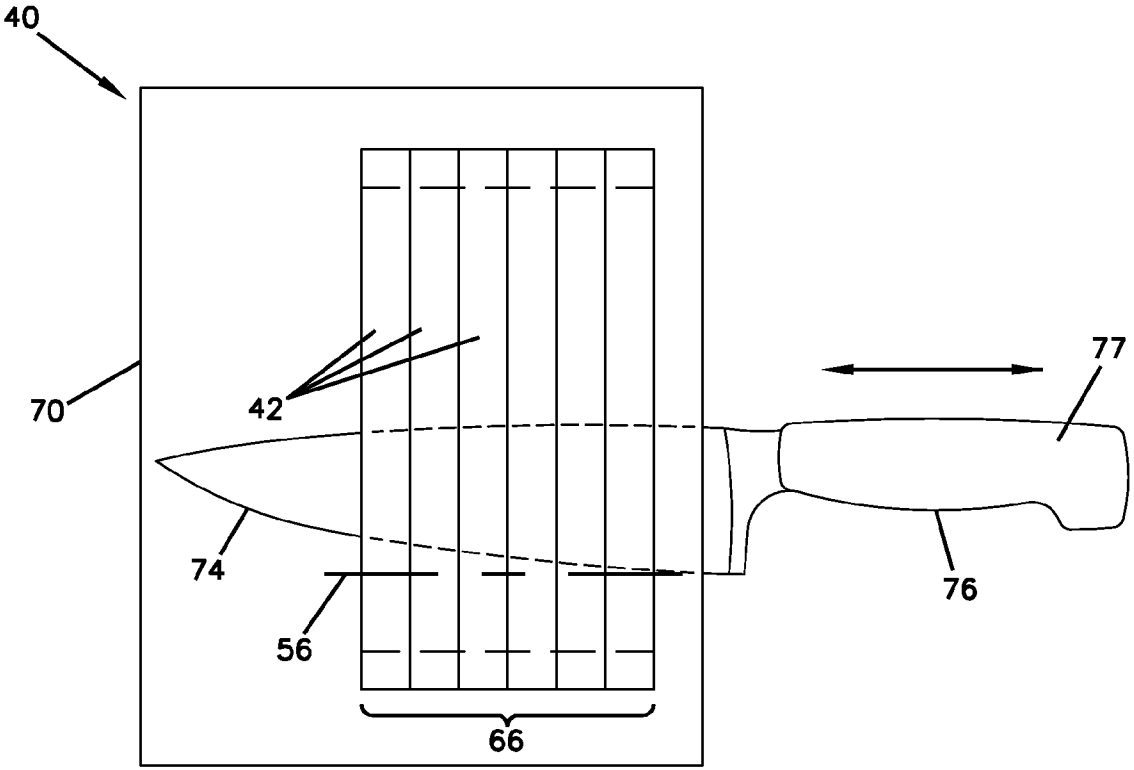
FIG. 7 is a side view showing a knife being processed at a processing location suitable for processing a blade with a convex cutting edge profile.
Figure 8:
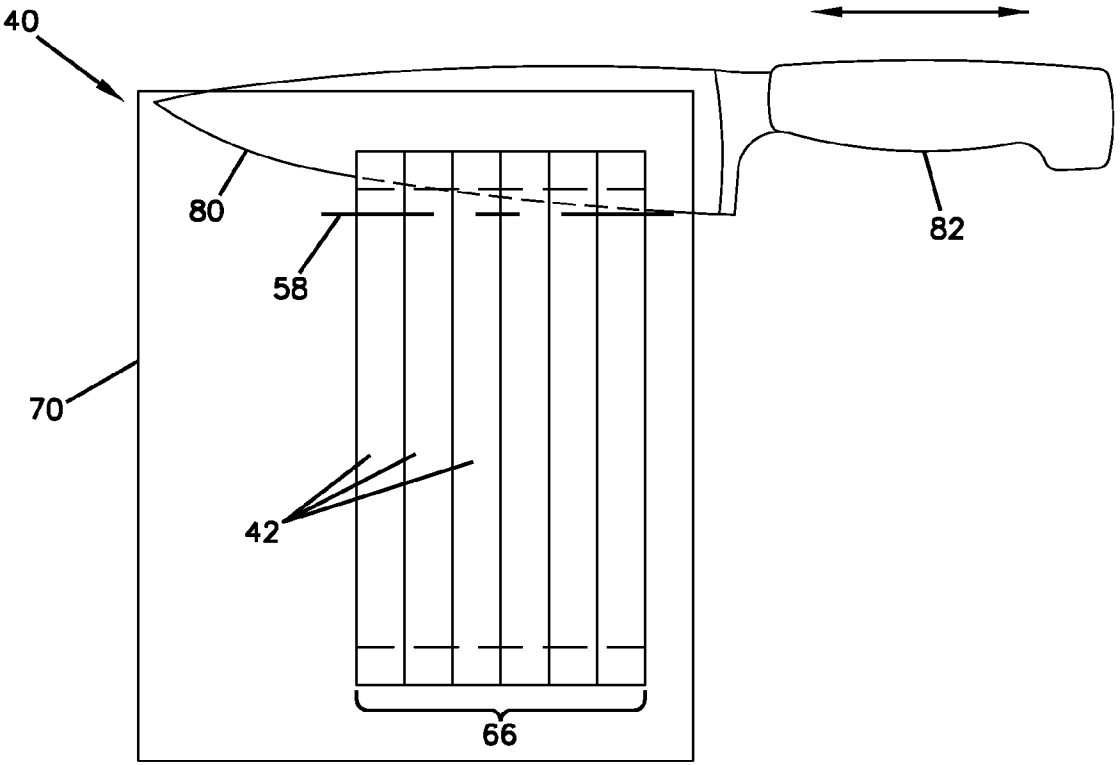
FIG. 8 is a side view showing a knife being processed at a processing location suitable for processing a blade with a concave cutting edge profile.

Referring to FIGS. 6-8, the blade edge processing device 40 can also include a protective housing 70 that at least partially encloses the first and second ring sets 66, 68. The protective housing 70 is shown including a first blade insertion opening 72 that aligns with the first blade processing notch 48 defined by the overlapping first and second ring sets 66, 68. The first blade insertion opening 70 allows a blade 74 of a knife 76 to be inserted from outside the housing 70 into the first notch 48 within the protective housing 70. During insertion, the blade 74 of the knife 76 is moved along the first blade insertion axis 56 as shown at FIG. 7. The protective housing 70 also includes a second blade insertion opening 78 that aligns with the second notch 50. The second blade insertion opening 78 allows a blade 80 of a knife 82 to be inserted from outside the housing 70 into the second notch 50 within the protective housing 70. The blade 80 is moved along the second blade insertion axis 58 as the blade 80 is inserted through the second blade insertion opening 78 and into the second notch 50 (see FIG. 8). In a preferred embodiment, the first notch 48 is positioned no more than two inches from the first blade insertion opening 72 measured in an orientation along the first blade insertion axis 56.

Figure 9:
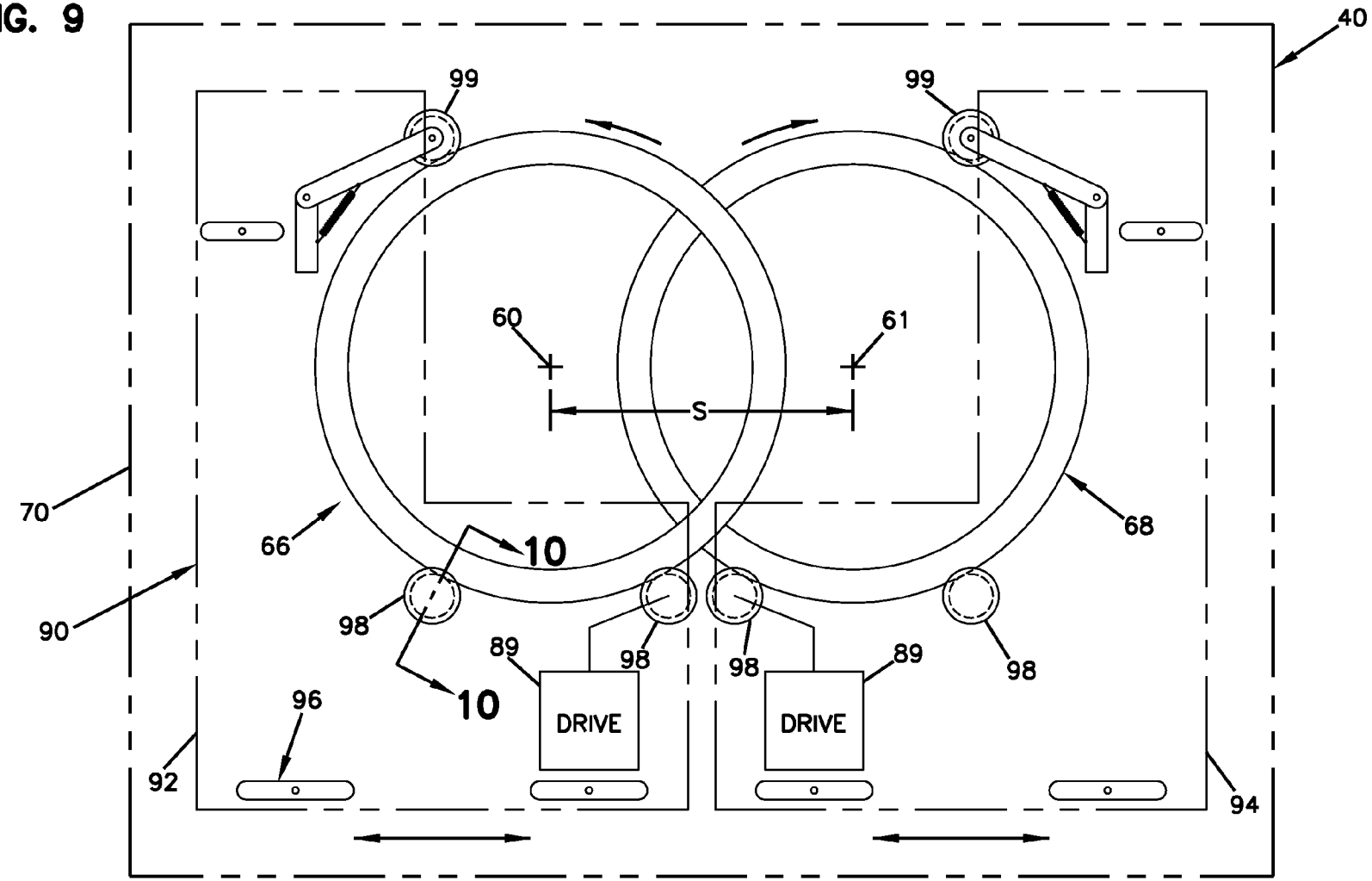
FIG. 9 schematically shows an example frame and drive arrangement for supporting and powering the blade processing device of FIG. 4.

FIG. 9 shows the first and second ring sets 66, 68 supported on a support structure 90 (e.g., a frame, framework or like structure) mounted within the protective housing 70. The support structure 90 includes a first component 92 supporting the first ring set 66 and a second component 94 supporting the second ring set 68. The first and second components 92, 94 can be slidably connected to the protective housing 70 (e.g., by a pin and slot arrangement 96 or other suitable structure) to allow the spacing S between the axes of rotation 60, 61 to be adjusted. It will be appreciated that the support structure 90 can include a retention/locking structure for preventing movement of the first and second components 92, 94 relative to one another once a desired spacing S has been set.

Figure 10:
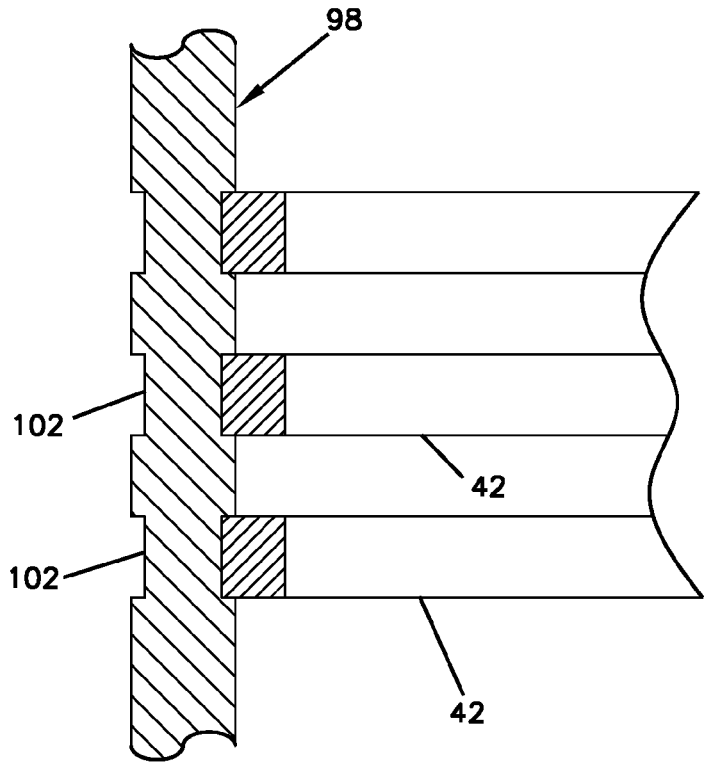
FIG. 10 is a cross-sectional view taken along section line 10-10 of FIG. 9.

The first and second components 92, 94 can include lower rollers 98 that form cradles for supporting the first and second ring sets 66, 68. The first and second components 92, 94 can also include upper biasing rollers 99 that apply a downward biasing force to the first and second ring sets 66, 68 to assist in retaining the first and second ring sets 66, 68 in their respective cradles. As shown at FIG. 10, the lower rollers 98 can include notches 102 for receiving the edge processing rings 42 to limit axial movement of the edge processing rings 42 relative to one another along the axes of rotation 60, 61. As shown at FIG. 9, certain ones of the lower rollers 98 can be driven rollers coupled to a drive arrangement 89. The drive arrangement 89 rotates the driven rollers which in turn rotate the first and second ring sets 66, 68 about their respective first and second axes of rotation 60, 61.

In use of the blade processing device 40, the blade 74 of the knife 76 is inserted through the first blade insertion opening 72 and into the first notch 48 while at least a portion of a handle 77 of the knife 76 remains outside the protective housing 70 (e.g., see FIG. 7). The knife blade 74 is then moved back and forth axially along the first blade insertion axis 56 with an edge of the knife blade 74 positioned within the first notch 48. Concurrently, the first and second ring sets 66, 68 are preferably rotated about their respective axes of rotation 60, 61. At least a portion of the knife handle 77 preferably remains outside the protective housing 70 as the knife blade 74 is moved within the first notch 48. As shown at FIG. 6, the knife blade 74 defines a central reference plane 79 that bisects an edge 81 of the knife blade 74. The central reference plane 79 is oriented generally in a vertical orientation during sharpening (see FIG. 6).

Figure 11:
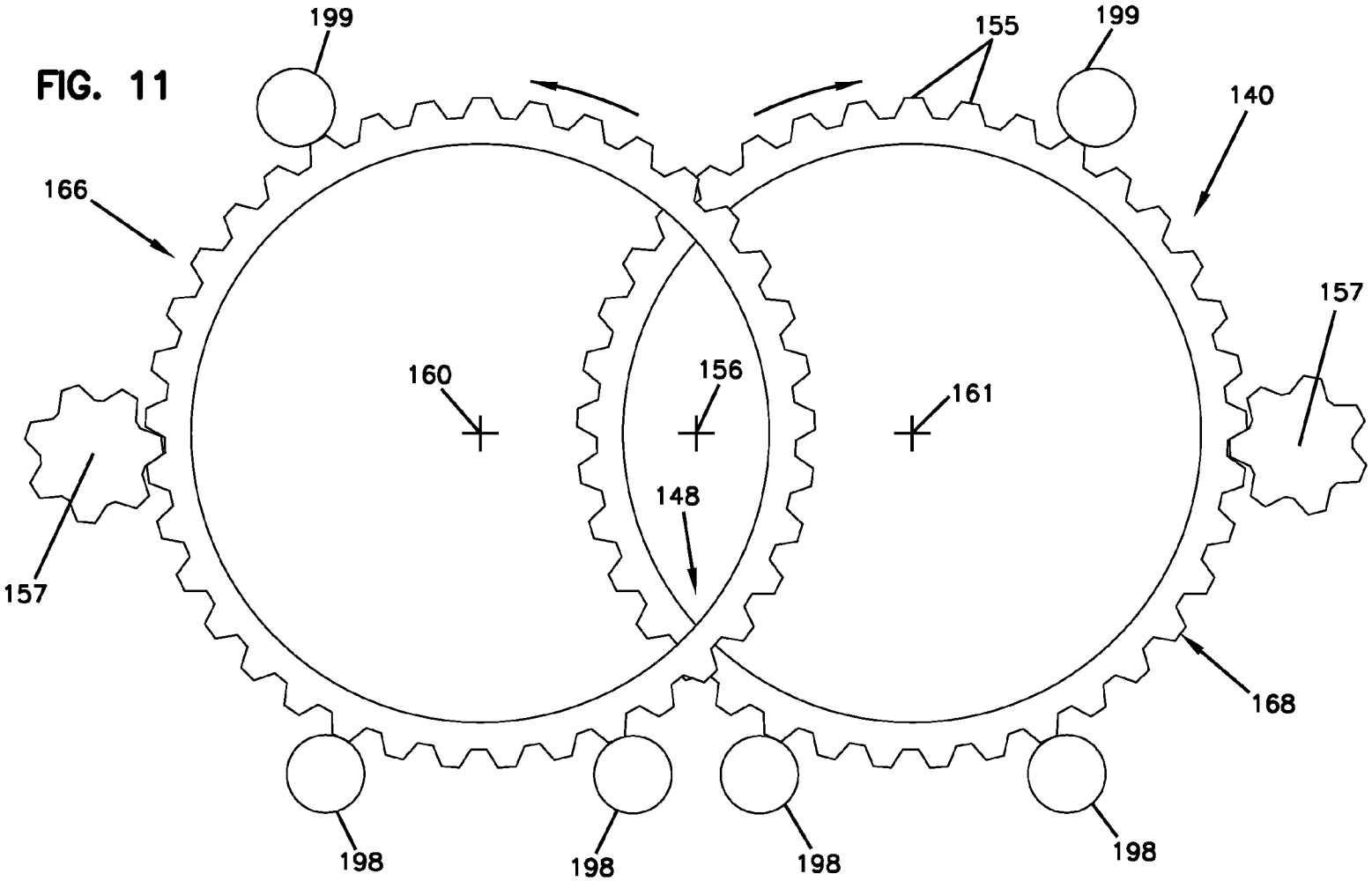
FIG. 11 is a front view of another blade edge processing device in accordance with the principles of the present disclosure having intermeshed edge processing coils supported on rollers and driven by side gears.
Figure 12:
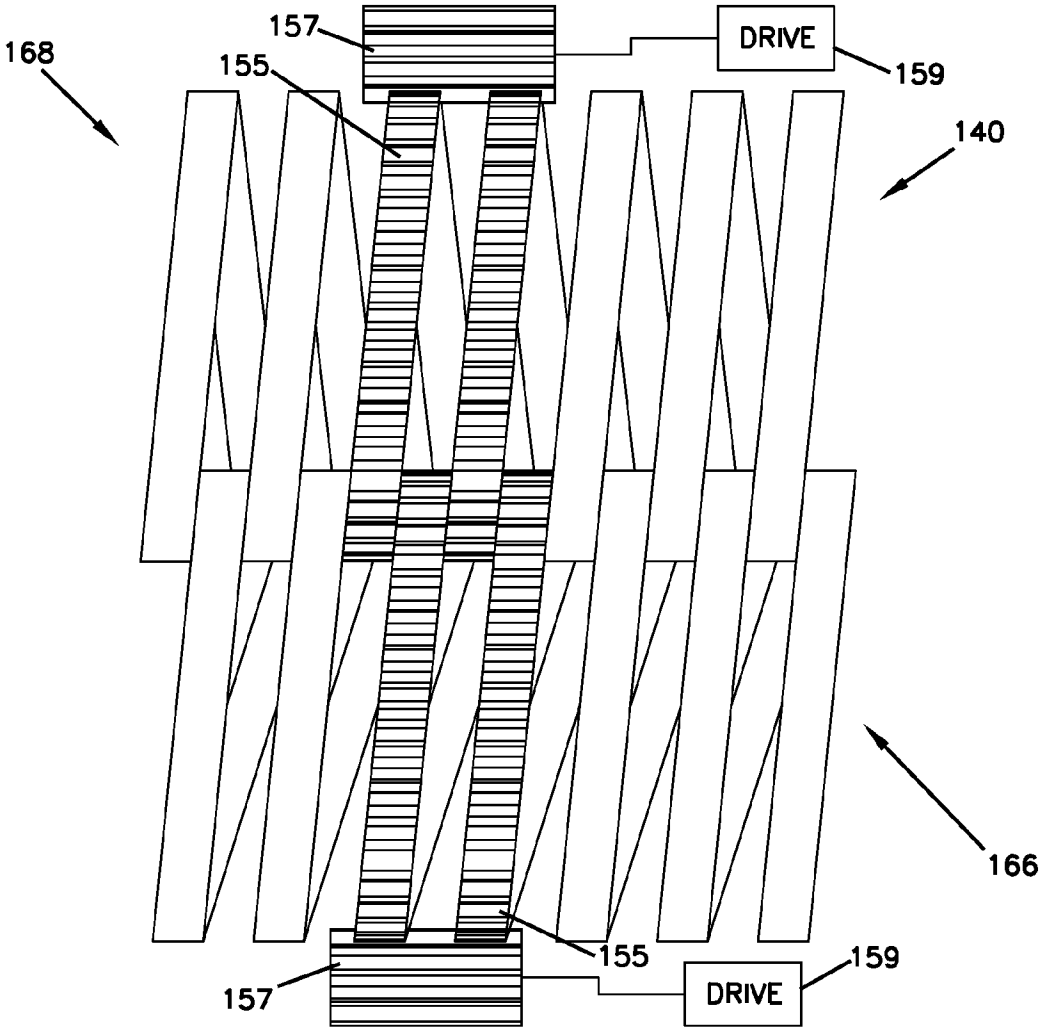
FIG. 12 is a top view of a blade edge processing device of FIG. 11 with the rollers omitted for clarity.

FIGS. 11 and 12 show another blade edge processing device 140 in accordance with the principles of the present disclosure. The blade edge processing device 140 includes first and second helical coils 166, 168 that are interleaved relative to one another so as to define a blade processing location in the form of an inner notch 148. Inner diameters of the first and second helical coils 166, 168 are adapted for processing a blade edge. Helical wraps of the first and second helical coils 166, 168 define edge processing rings that cooperate to define the inner notch 148. The inner diameters of the first and second helical coils 166, 168 have concave curvatures such that the inner notch 148 is adapted for processing a blade having a convex cutting edge profile. As shown at FIG. 12, selected wraps of the first and second helical coils 166, 168 can include outer gear teeth 155 that engage spur gears 157 driven by a drive arrangement 159. The drive arrangement 159 can be configured for rotating the first and second helical coils 166, 168 about first and second spaced-apart axes of rotation 160, 161. The first and second helical coils 166, 168 can be supported on cradles defined by lower rollers 198. Upper biasing rollers 199 can assist in retaining the first and second helical coils 166, 168 within the cradles.

During blade processing, a blade is inserted into the inner notch 148 such that the edge engages the inner diameter surfaces of the first and second helical coils 166, 168. The first and second helical coils 166, 168 are rotated about their respective axes 160, 161 and the knife blade can be moved in and out along a blade insertion axis 156 that is parallel to the first and second axes of rotation 160, 161. During sharpening, the helical angling of the wraps of the first and second helical coils 166, 168 assist in drawing a bead of material removed from the blade along the length of the blade.

Figure 13:
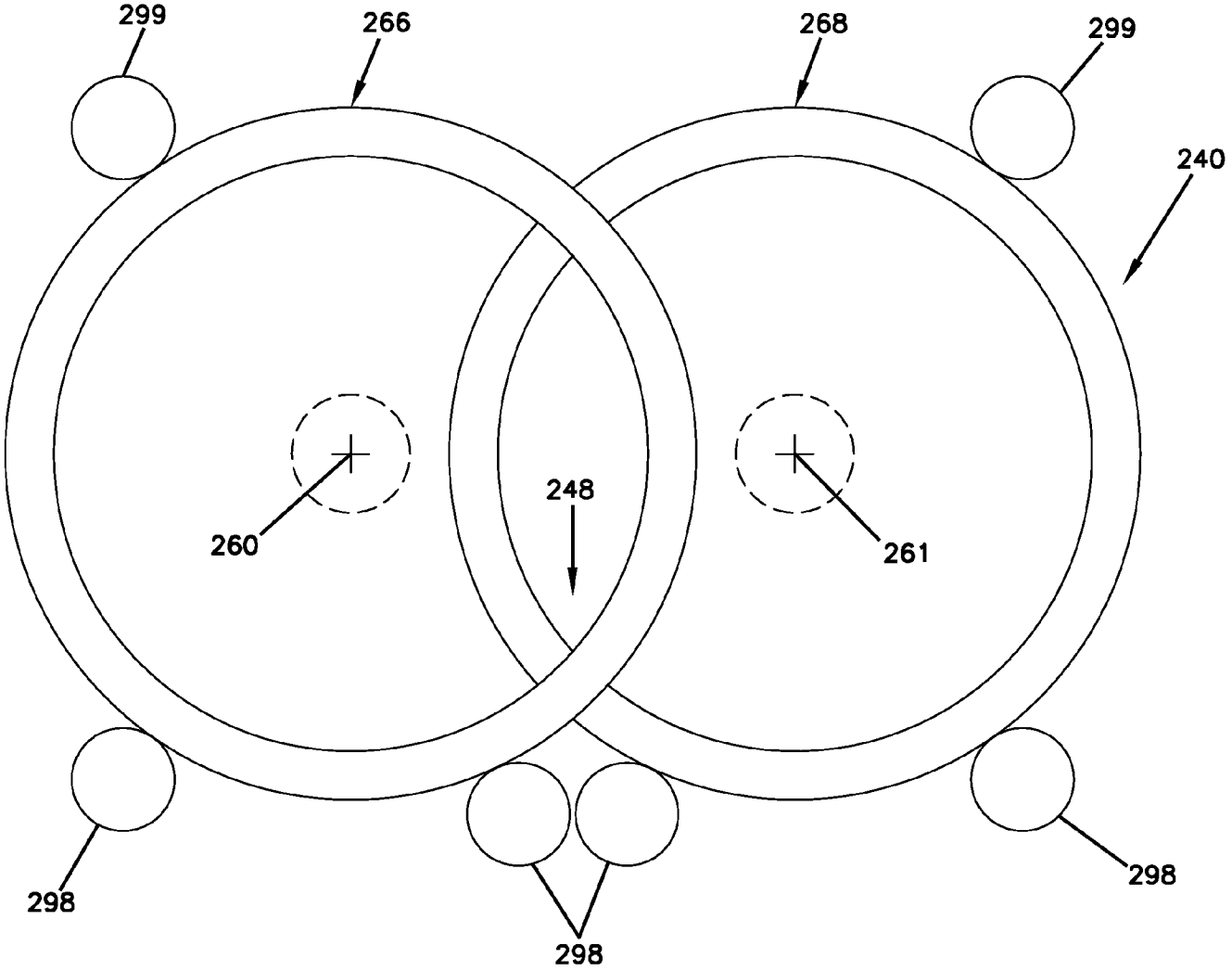
FIG. 13 is a front view of a further blade edge processing device in accordance with the principles of the present disclosure having intermeshed edge processing coils supported on rollers and driven by an end drive arrangement.
Figure 14:
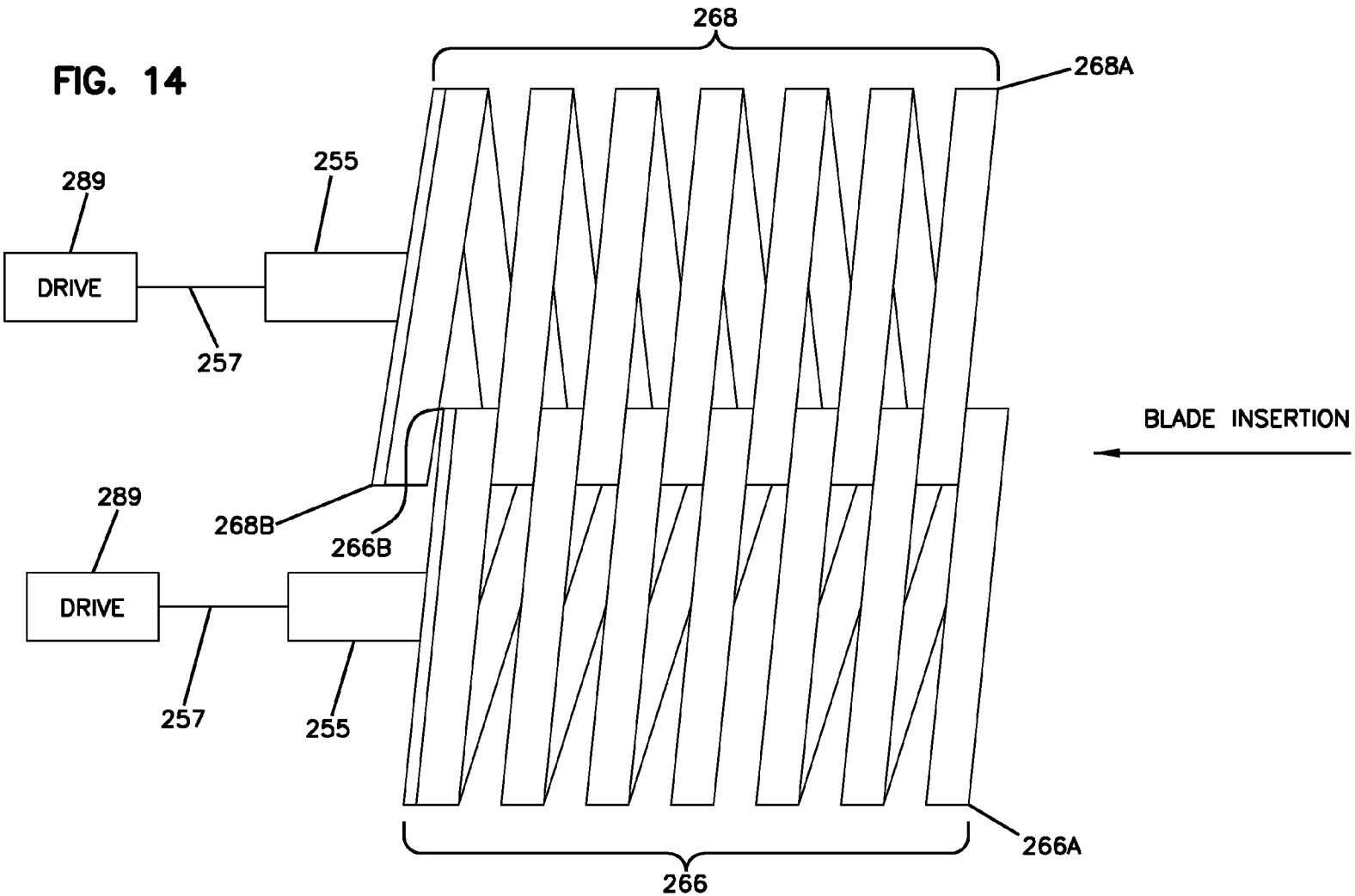
FIG. 14 is a top view of the blade edge processing of FIG. 13 with the rollers omitted for clarity.

FIGS. 13 and 14 show another blade processing device 240 in accordance with the principles of the present disclosure. The blade processing device 240 includes first and second interleaved helical coils 266, 268. The first and second helical coils 266, 268 include inner diameters having inner diameter surfaces suitable for processing the edge of a blade. The first and second helical coils 266, 268 cooperate to define a blade processing notch 248 adapted to receive a blade and to process a convex cutting edge profile of the blade. As shown at FIG. 13, the first and second helical coils 266, 268 can be supported on cradles defined by lower rollers 298. Upper biasing rollers 299 can be used to assist in retaining the first and second helical coils 266, 268 within the cradles. The first and second helical coils 266, 268 can include first ends 266A, 268A positioned opposite from second ends 266B, 268B.

In use, a blade desired to be processed is inserted into the blade processing notch 248 at the first ends 266A, 268A of the first and second helical coils 266, 268. End plates 255 are mounted at the second ends 266B, 268B of the first and second helical coils 266, 268. Drive shafts 257 are coupled to the end plates 255. A drive arrangement 289 is coupled to the drive shafts 257 and is used to rotate the first and second helical coils 266, 268 about respective first and second axes of rotation 260, 261 during processing of a blade edge.

Figure 15C:
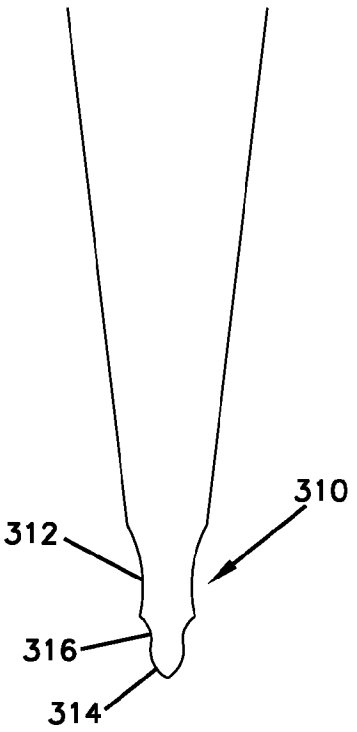
FIG. 15C illustrates a third convex cutting edge profile that can be processed using devices and methods in accordance with the principles of the present disclosure.
Figure 15B:
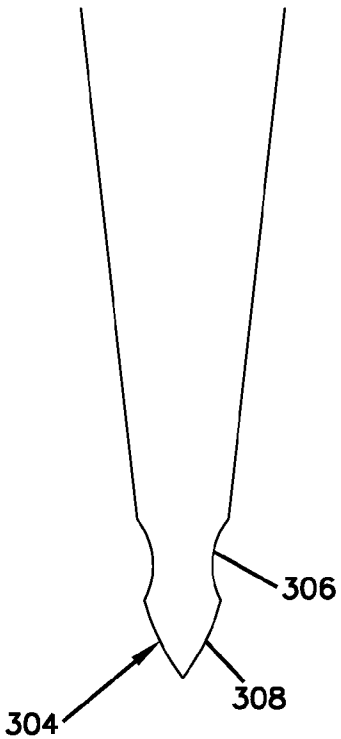
FIG. 15B shows a second convex cutting edge profile that can be processed using devices and methods in accordance with the principles of the present disclosure.
Figure 15A:
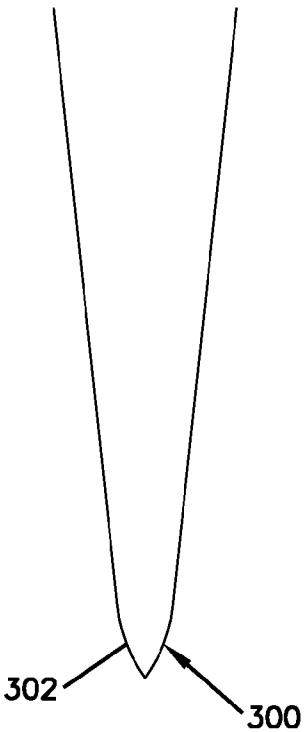
FIG. 15A shows a first convex cutting edge profile that can be processed using methods and devices in accordance with the principles of the present disclosure.

FIGS. 15A-15C show various blade edges that can be processed using equipment in accordance with the principles of the present disclosure. FIG. 15A shows a standard knife blade 300 having a convex cutting edge profile 302. FIG. 15B shows a hollow ground blade 304 having a hollow ground region 306 and a convex cutting edge profile 308 positioned adjacent to the hollow ground region 306. FIG. 15C shows a blade 310 having a hollow ground region 312 and a convex cutting edge profile 314. An intermediate concave region 316 is positioned between the hollow ground region 312 and the convex cutting edge profile 314.

From the foregoing detailed description, it will be evident that modifications and variations can be made in the devices or methods of the disclosure without departing from the spirit or scope of the inventive aspects.

What is claimed is:

1. A device for processing an edge of a blade, the device comprising:

a housing defining a blade insertion opening for allowing the blade to be inserted from outside the housing into the housing through the blade insertion opening; and first and second edge processing rings mounted within the housing, the first and second edge processing rings having inner diameter surfaces suitable for processing the edge of the blade, the first edge processing ring being rotatable relative to the housing about a first axis and the second edge processing ring being rotatable relative to the housing about a second axis, the first and second axes being spaced-apart from one another, the first and second edge processing rings overlapping each other such that the inner diameter surfaces of the first and second edge processing rings form an inner blade processing notch, the inner blade processing notch being aligned with a blade insertion axis that extends though the blade insertion opening, the inner blade processing notch being configured to receive the blade when the blade is inserted through the blade insertion opening along the blade insertion axis, wherein when the blade is received within the inner blade processing notch while the first and second edge processing rings are rotated about their respective first and second axes, the edge of the blade engages and is processed by the inner diameter surfaces of the first and second edge processing rings.

2. The device of claim 1, wherein the first and second axes are parallel and wherein a spacing between the first and second axes is adjustable.

3. The device of claim 1, wherein the inner diameter surfaces of the first and second edge processing rings correspond with inner diameters of the first and second edge processing rings, wherein the inner diameter surface of the first and second edge processing rings have axial dimensions that correspond to widths of the first and second edge processing rings, wherein the axial dimensions are measured along orientations that extend along the first and second axes, and wherein the axial dimensions are shorter than the inner diameters.

4. The device of claim 3, each inner diameter is at least two times as long as each corresponding axial dimension.

5. The device of claim 3, wherein each inner diameter is at least four times as long as each corresponding axial dimension.

6. The device of claim 3, wherein each inner diameter is at least ten times as long as each axial dimension.

7. The device of claim 3, wherein each inner diameter is at least 20 times as long as each axial dimension.

8. The device of claim 3, wherein the axial dimension of each of the first and second edge processing rings is less than an inch.

9. The device of claim 3, wherein the axial dimension of each of the first and second edge processing rings is less than one half of an inch.

10. The device of claim 1, wherein the inner diameter surfaces are adapted for sharpening the edge of the blade.

11. The device of claim 1, wherein the blade insertion notch is positioned no more than 2 inches from the blade insertion opening measured in an orientation along the blade insertion axis.

12. The device of claim 1, further comprising a third edge processing ring mounted within the housing, the third edge processing ring having an inner diameter surface suitable for processing the edge of the blade, the third edge processing ring being rotatable relative to the housing about the first axis, the third edge processing ring cooperating with the first and second edge processing rings to define the inner blade processing notch.

13. The device of claim 1, further comprising a fourth edge processing ring mounted within the housing, the fourth edge processing ring having an inner diameter surface suitable for processing the edge of the blade, the fourth edge processing ring being rotatable relative to the housing about the second axis, the third edge processing ring cooperating with the first, second and third edge processing rings to define the inner blade processing notch.

14. The device of claim 13, wherein the first, second, third and fourth edge processing rings all have equal inner diameters, and wherein the first and second axes are parallel.

15. The device of claim 13, wherein the first, second, third and fourth edge processing rings are each separate cylindrical rings.

16. The device of claim 13, wherein the first and third edge processing rings are helical and are part of a first helical coil structure, and wherein the second and fourth edge processing rings are helical and are part of a second helical coil structure interleaved with the first helical coil structure.

17. The device of claim 1, further comprising a drive arrangement for rotating the first edge processing ring about the first axis and for rotating the second edge processing ring about the second axis.

18. The device of claim 1, wherein the first and second edge processing rings have outer diameter surfaces suitable for processing the edge of the blade, and wherein the outer diameter surfaces define an outer blade processing notch for processing the blade.

19. The device of claim 1, wherein a spacing between the first and second axes is adjustable.

20. A method for using the device of claim 1 to sharpen a knife having a knife blade and a knife handle, the method comprising:

inserting the knife blade through the blade insertion opening and into the inner blade processing notch while at least a portion of the knife handle remains outside the housing; and moving the knife blade back and forth along the blade insertion axis with an edge of the knife blade positioned within the inner blade processing notch while the first and second edge processing rings are respectively rotated about the first and second axes, wherein at least a portion of the knife handle remains outside the housing as the knife blade is moved within the blade processing notch.

21. The method of claim 20, wherein the knife blade defines a central reference plane that extends through the knife blade edge, and wherein the central reference plane is oriented generally in a vertical orientation during sharpening.

22. A device for processing an edge of a blade, the device comprising:

first and second edge processing rings having inner diameter surfaces suitable for processing the edge of the blade, the first edge processing ring being rotatable about a first axis and the second edge processing ring being rotatable about a second axis, the first and second axes being spaced-apart from one another, the first and second edge processing rings overlapping each other such that the inner diameter surfaces of the first and second edge processing rings form an inner blade processing notch, the inner blade processing notch being configured to receive the blade for processing, wherein when the blade is received within the inner blade processing notch while the first and second edge processing rings are rotated about their respective first and second axes, the edge of the blade engages and is processed by the inner diameter surfaces of the first and second edge processing rings, and wherein a spacing between the first and second axes is adjustable.

23. A device for processing an edge of a blade, the device comprising:

first and second edge processing rings having inner diameter surfaces suitable for processing the edge of the blade, the first edge processing ring being rotatable about a first axis and the second edge processing ring being rotatable about a second axis, the first and second axes being spaced-apart from one another, the first and second edge processing rings overlapping each other such that the inner diameter surfaces of the first and second edge processing rings form an inner blade processing notch, the inner blade processing notch being configured to receive the blade for processing, wherein when the blade is received within the inner blade processing notch while the first and second edge processing rings are rotated about their respective first and second axes, the edge of the blade engages and is processed by the inner diameter surfaces of the first and second edge processing rings, and wherein the first and second edge processing rings have outer diameter surfaces suitable for processing the edge of the blade, and wherein the outer diameter surfaces define an outer blade processing notch for processing the blade.

24. A device for processing an edge of a blade, the device comprising:

first and second edge processing rings having inner diameter surfaces suitable for processing the edge of the blade, the first edge processing ring being rotatable about a first axis and the second edge processing ring being rotatable about a second axis, the first and second axes being spaced-apart from one another, the first and second edge processing rings overlapping each other such that the inner diameter surfaces of the first and second edge processing rings form an inner blade processing notch, the inner blade processing notch being configured to receive the blade for processing, wherein when the blade is received within the inner blade processing notch while the first and second edge processing rings are rotated about their respective first and second axes, the edge of the blade engages and is processed by the inner diameter surfaces of the first and second edge processing rings, wherein the inner diameter surfaces of the first and second edge processing rings correspond with inner diameters of the first and second edge processing rings, wherein the inner diameter surfaces of the first and second edge processing rings have axial dimensions that correspond to widths of the first and second edge processing rings, wherein the axial dimensions are measured along orientations that extend along the first and second axes, and wherein the axial dimensions are shorter than the inner diameters.

25. The device of claim 24, wherein each inner diameter is at least four times as long as each corresponding axial dimension.

26. The device of claim 24, wherein each inner diameter is at least ten times as long as each corresponding axial dimension.

27. A device for processing an edge of a blade, the device comprising:

first, second, third and fourth edge processing rings having inner diameter surfaces suitable for processing the edge of the blade, the first and third edge processing rings being rotatable about a first axis and the second and fourth edge processing rings being rotatable about a second axis, the first and second axes being spaced-apart from one another, the first and third edge processing rings overlapping the second and fourth edge processing rings such that the inner diameter surfaces of the first, second, third and fourth edge processing rings form an inner blade processing notch, the inner blade processing notch being configured to receive the blade for processing, wherein when the blade is received within the inner blade processing notch while the first, second, third and fourth edge processing rings are rotated about their respective first and second axes, the edge of the blade engages and is processed by the inner diameter surfaces of the first, second, third and fourth edge processing rings.

* * * * *